US005220150A

United States Patent [19]

Pfender et al.

[11] Patent Number: 5,220,150

[45] Date of Patent: Jun. 15, 1993

[54] PLASMA SPRAY TORCH WITH HOT ANODE AND GAS SHROUD

[75] Inventors: Emil Pfender, West St. Paul; Stuart J. Malmberg, Minneapolis, both of Minn.

[73] Assignee: Regents of the University of Minnesota, Minneapolis, Minn.

[21] Appl. No.: 694,985

[22] Filed: May 3, 1991

[51] Int. Cl.[5] ..... B33K 9/00

[52] U.S. Cl. ..... 219/121.51; 219/121.48; 219/121.5; 219/121.52

[58] Field of Search ..... 219/121.5, 121.49, 121.51, 219/121.52, 75

[56] References Cited

U.S. PATENT DOCUMENTS

| | | | |
|---|---|---|---|
| 3,470,347 | 9/1969 | Jackson | 219/76 |
| 4,121,082 | 10/1978 | Harrington et al. | 219/76.16 |
| 4,369,919 | 1/1983 | Beloev et al. | 219/121.51 |
| 4,656,330 | 4/1987 | Poole | 219/121.5 |
| 4,682,005 | 7/1987 | Marhic | 219/121.52 |
| 4,762,977 | 8/1988 | Browning | 219/121.51 |
| 4,777,343 | 10/1988 | Goodwin | 219/121.51 |
| 4,841,114 | 6/1989 | Browning | 219/121.47 |
| 4,851,636 | 7/1989 | Sugimoto et al. | 219/121.51 |
| 4,902,871 | 2/1990 | Sanders et al. | 219/121.49 |

OTHER PUBLICATIONS

Article entitled "A Gas-Shrouded Plasma Spray Torch" by Fleck et al., *Proceeding of the 7th International Symposium on Plasma Chemistry*, vol. 4, p. 1113 (1985).

*Primary Examiner*—Mark H. Paschall
*Attorney, Agent, or Firm*—Kinney & Lange

[57] ABSTRACT

A gas shrouded plasma torch utilizes a hot anode that has an inert gas passing around the periphery of the anode to provide an inert gas shroud for a plasma stream exiting from the anode. The gas shroud is heated as it passes around the exterior of the hot anode, and when it exits from the passageway and forms a shroud, it mixes with and shields the hot plasma. The arrangement gives the results of less turbulence of the plasma flow, while retaining a high temperature which aids in particle processing.

2 Claims, 2 Drawing Sheets

PLASMA SPRAY TORCH WITH HOT ANODE AND GAS SHROUD

BACKGROUND OF THE INVENTION

The present invention relates to a hot anode plasma torch having a gas shroud heated by the anode for providing greater stability of the plasma effluent jet, while maintaining high core temperatures and velocities, to provide a favorable environment for heating of particles injected into the plasma jet.

Conventional plasma spraying in atmospheric air suffers from severe air entrainment into the plasma jet. This air entrainment entails two major problems: (1) it cools the plasma jet, leading to a rapid decay of the jet temperature and the associated heating of particulates injected into the plasma jet during the spray process; (2) the entrained air causes oxidation of metallic particulates which frequently precludes utilization of this approach for spraying of metals and alloys. In order to prevent this problem, low pressure plasma spraying (LPPS) has been introduced where the spray process is done in an environmental chamber at reduced pressures and in a controlled atmosphere (for example in argon).

Although this process produces excellent coatings, it is extremely expensive. Even though the aircraft industry has been using this process extensively for spraying of engine parts efforts are being made to move away from this expensive technology and gas shrouding of the plasma jet is one of the approaches which is under consideration. This process will at least delay the entrainment of air during atmospheric pressure plasma spraying. In the prior art, various plasma torches have been utilized which have a gas shroud for the torch. Such a device is shown in U.S. Pat. No. 3,470,347 which shields the gas effluent with a ring of fluid flow. However, this particular torch does not include a hot anode and hot shroud, which is desirable from the standpoint of obtaining high performance plasma, and merely has an annular jet or flow of gases that surround the plasma core.

U.S. Pat. No. 4,121,082 shows a structure that has a preheated gas shield that directs a flow of gas back toward the plasma source, that is, back toward the anode and cathode, so that the shroud gas flow is a reverse direction from the plasma effluent.

U.S. Pat. No. 4,841,114 also showns a high velocity, control temperature plasma spray method having an elongated anode that has a gas stream on the interior of the anode to surround the core of plasma.

In an article entitled "A Gas-Shrouded Plasma Spray Torch" by Fleck et al, and published in the Proceeding of the 7th International Symposium on Plasma Chemistry, Vol. 4, page 1113 (1985), a description of a gas shroud using a conventional torch indicated that the plasma effluent increased in length, and through modeling described in the paper, there was a predicted reduction of oxygen entrainment and consequently the reduction of oxide formation in the coating. Thus, the shrouding of a plasma torch reduces the oxides that can appear in the coating that is being formed and is desirable.

The use of a hot anode, that is, an anode that is not cooled with water or other liquid provides a way of having a shroud gas flow that is heated by the anode, and thus aids in cooling the anode, the shroud gas flow surrounds the anode, and then intermixes with the plasma as the plasma flows out of the plasma torch.

SUMMARY OF THE INVENTION

The present invention relates to a hot anode plasma torch that has a annular curtain of gas traveling along the exterior of the anode, which has a central bore, and flowing in the same direction as the flow of plasma from the torch. The plasma core is surrounded by hot inert gas as the plasma exits the anode. The inert gas shields the core as well as intermixing with the core as it is discharged from the plasma torch. This arrangement provides for a stable flow of plasma effluent, and eliminates undesirable premature mixing with the surrounding air, producing an elongated plasma jet. The longer jet provides a better heating environment for injected powder after the plasma exits the torch. The hot shroud widens the effective cross-section of the hot plasma jet, providing additional heating for injected powders. The overall torch performance is enhanced without consumption of additional power, and without requiring direct water cooling of the anode, which reduces torch efficiency.

The present invention has utility in DC arc processes, such as plasma spraying. The torch has a higher power efficiency than conventional DC spray torches of similar design, and the hot anode design allows for a more diffuse anode arc attachment leading to a more stable and more repeatable arc compared to a conventional torch design.

DETAILED DESCRIPTION OF THE PREFERRED EMBODIMENTS

Figure 1:
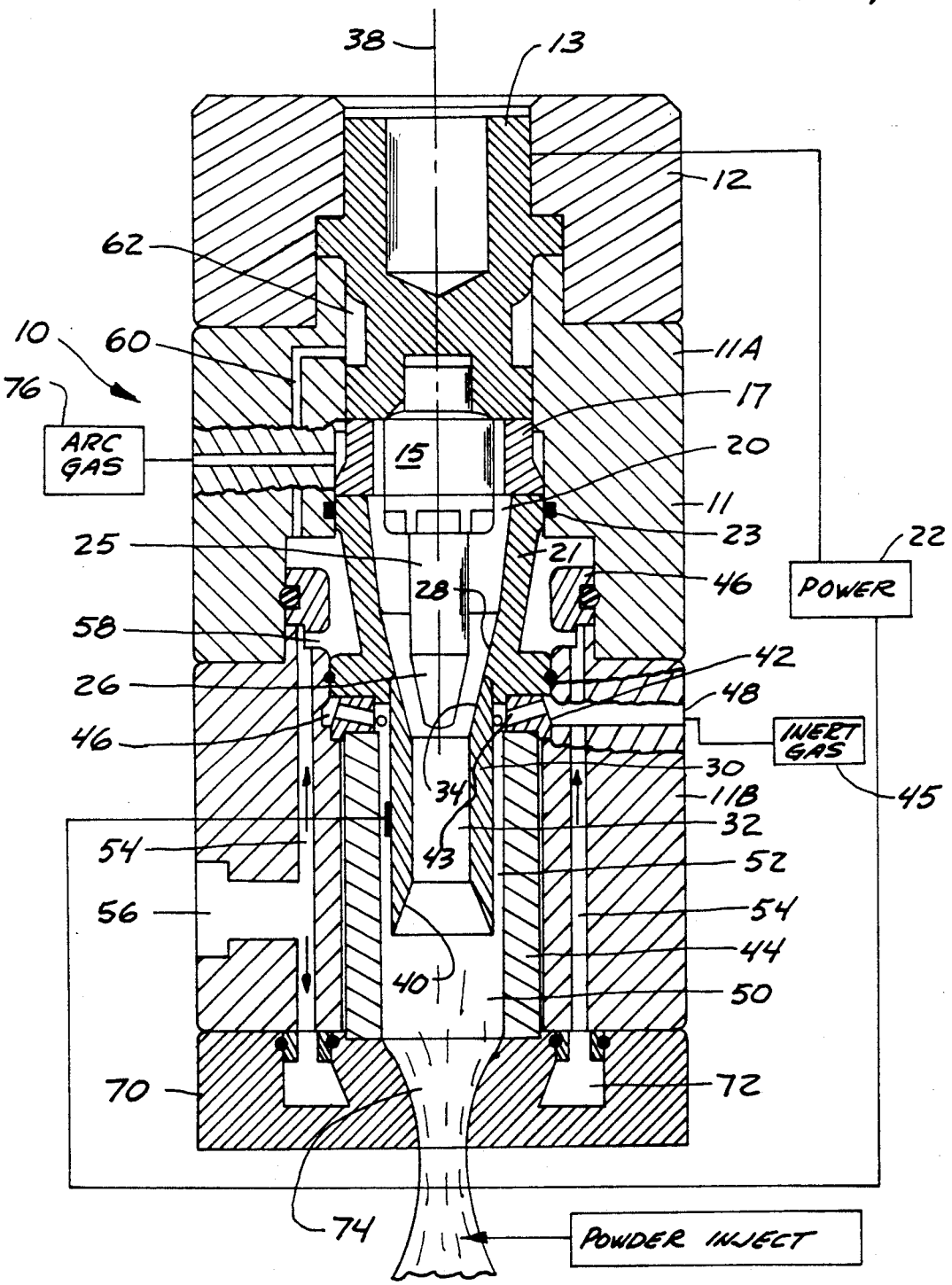
FIG. 1 is a vertical sectional view of a plasma torch made according to the present invention.

A plasma torch indicated generally at 10 has a suitable body 11 of material that resists the heat involved, and as shown, it is a multi-section body. The main mounting end 12 supports a cathode support 13 which is also used for carrying DC power to the cathode. This support is suitably held in the body 11, as shown, and it can be of conventional design. A rod-like cathode 15 is supported in the support 13, and extends downwardly through an interior chamber defined in part by an arc gas injector ring 17. This is either a type of porous ring, or a ring having small holes that permits arc gas to be introduced into a cathode chamber 20 that is defined by a copper anode base 21. The anode base 21 is electrically insulated from the cathode support 13 and the cathode 15 to permit completing a circuit that is schematically shown in the drawings, and includes a power source 22 providing power to the cathode and the anode at suitable power levels.

The anode base 21 is suitably sealed with high temperature seals 23 to a housing section 11A, and held supported relative to this housing section. Further, the cathode 15 includes a tungsten cathode end rod 25 which fits within the chamber 20 and has a tapered converging end 26. The chamber formed on the interior of anode support base 21 also has an inwardly tapered end wall portion 28 that narrows in size, as can be seen, and the end of the anode support base 21 remote from ring 17 in turn supports a tubular tungsten anode 30. The anode 30 is held securely on the end of the support base 21 and defines an interior bore 32 with a tapered end surface 34 that continues the tapered surface of the tapered portion 28 adjacent the cathode. It can be seen that the tip 26 of the cathode fits within the tapered bore 34 of the anode. The bore 32 is aligned with the central axis of the cathode. This central axis is indicated at 38.

The anode has an axial length that extends in direction away from the cathode, and it has an exit bore 40 which expands outwardly.

The anode is supported at the end adjacent the cathode by an annular gas injection ring 42 that is supported between an end surface of the anode base 21 and an anode shield 44. The gas injection ring 42 fits 48 through which the shrouding gas can be injected, from an inert shroud gas source 45.

The shield 44 has an interior bore 50 that is larger than the outer diameter of the anode 30, and forms an annular passageway or space 52 that opens to the interior of the gas injection ring 42. The injection ring 42 has a series of openings 43 around the periphery of the anode to provide for injection of gas from the plenum chamber 46 into the passageway 52 surrounding the anode. The shield 44 in turn is surrounded by a housing section 11B which forms part of the housing 11, and, as shown, the housing 11B is an annular section that fits within the lower end of housing section 11A, and provides a number cooling passageways 54 that receive cooling water from an inlet connection 56. The water passageways 54 are made so that water will flow upwardly as indicated by the arrow, and enter in..to an annular chamber surrounding the anode base 21, to provide some cooling of the anode (not direct cooling), and the water will then flow through suitable passageways indicated just schematically at 60 in the housing portion 11A up into an annular plenum 62 surrounding the cathode support 13, and from there the water will be discharged to a suitable drain. The passageway for the drain is not shown.

Anode power can also be carried through the port 56, if desired, so that there is a direct connection to the anode, as shown schematically. This comes from the power source 22.

Nozzle plate 70 is mounted on the housing 11 at the lower end of the housing section 11B, and is provided with an annular cooling fluid chamber 72 that surrounds an exit nozzle 74 formed in the orifice plate and which joins the passageway 50 of the shield 44. The exit orifice plate 70 has a converging nozzle 74, to reduce the diameter of the plasma stream and shroud gas, to provide for stability of operation, and a somewhat longer plume or jet of plasma effluent from the orifice plate.

Suitable seals are used in the junction areas as can be seen, and a ring 46 can be used for holding the parts 11A and 11B together within the chamber or plenum 58 for the cooling water.

When the power is applied, the cathode, which is tungsten in the preferred form, is surrounded with a suitable arc gas from an arc gas source 76 entering through the arc gas injector ring 17, and into the chamber 20 surrounding the base end of the cathode. This flow is conventional, and the arc gas flows around the tungsten cathode rod 25 (it preferably is made of tungsten or other high temperature-resisting materials) and as the arc gas converges around the cathode tip portion 26 where an arc is formed with respect to the anode, plasma is formed in the space between the surfaces of the converging surface 34 of the anode 30 and the tip 26 of the cathode and flows toward the exit end of the anode through passageway 32.

At the same time, inert shroud gas from a source 45 is being introduced through passageway 48 and through the injector ring 42 into the annular passageway 52. It should be noted that the openings 43 in the ring 42 are inclined slightly in the direction of flow toward the exit nozzle 74. The inert gas flows down between the inner surface of shield 44 (which can be copper or a suitable ceramic) and the exterior of the anode 30 (which is hot), and is heated as it flows in the direction of flow of the plasma. The diverging nozzle end 40 of the hot anode causes the plasma to widen out slightly at the same time the shroud gas surrounding the plasma jet is slightly intermixing with the periphery of the plasma jet. The plasma and surrounding hot gas shroud exit through converging nozzle 74 which stabilizes the jet, and provides a stable shroud of inert gas to prevent oxidation of the plasma as it exits the nozzle.

The hot shroud gas does not reduce the energy of the plasma effluent significantly because it is hot, and the plasma effluent or plume will remain stable for a substantial exit length. This aids in heating powders injected into the plasma and aids in satisfactory operation during plasma spraying operations.

Figure 2:
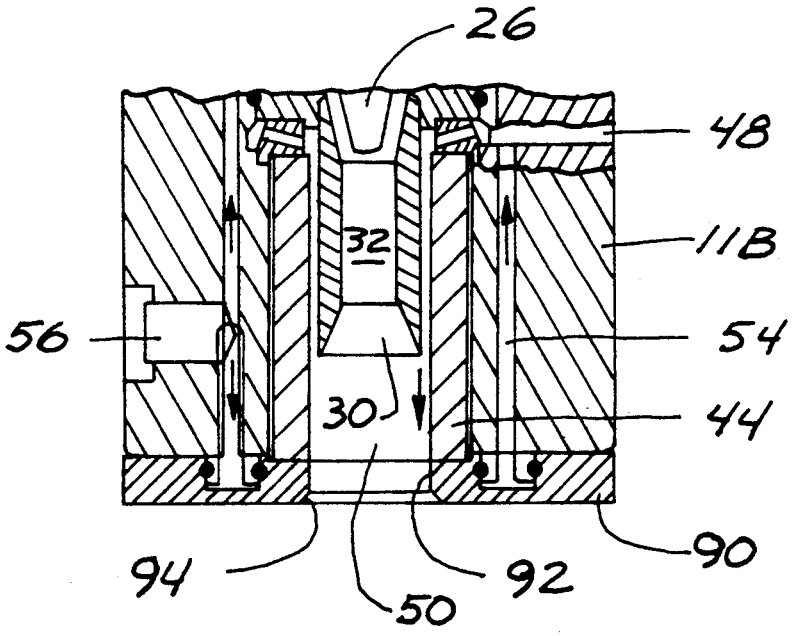
FIG. 2 is the plasma torch of FIG. 1 with a modified exit orifice shown thereon.

A modified form of the invention is shown in FIG. 2, and the torch construction is exactly the same as that described in connection with FIG. 1. However, a separate nozzle plate is provided, in place of the nozzle plate 74. As can be seen, the nozzle plate 90 in the embodiment of FIG. 2 has an outlet nozzle 92 which is the same diameter as the passageway 50 on the interior of the shield 44, and has a slight diverging flair 94 at its outer end. This provides a very wide plasma jet or plume, and the gas shroud contains the plasma. Because this jet is of greater diameter, there are certain advantages in discharging the effluent, such as larger cross-section. The converging nozzle reduces the instability, and while making a narrower core, results in a longer jet, where this is desirable. I t also has been found desirable to have the velocity of the shroud gas slightly greater than the velocity of the arc gas on the interior of the anode. Temperatures on the anode itself can come into the range of over 1500° K. The shield 44 can reach 800° K. Gas velocities for the shroud gas can be in the range of 20 plus meters per second, with an arc gas inlet velocity in the range of 10–15 meters per second has been found satisfactory. A suitable shroud gas is an inert gas such as argon, and the arc gases can be those which are desired for the type of plasma needed.

It should be noted that the water cooling passageways in the housing section 11B are to aid in cooling the shield 44. The ceramic shield receives radiation from the anode so that there is radiation cooling of the anode, as well as cooling caused by heat transfer to the shroud gas. The body 11 can be made of copper. The anode temperature remains very high. Some anode cooling is also effected by copper base 21, which is surrounded by cooling water.

Although the present invention has been described with reference to preferred embodiments, workers skilled in the art will recognize that changes may be made in form and detail without departing from the spirit and scope of the invention.

What is claimed is:

1. A plasma torch comprising:

a housing;

a first electrode mounted on said housing;

a second electrode mounted on said housing and comprising an annular electrode surrounding at least a part of the first electrode, said annular electrode having a central bore forming a passageway substantially aligning with the first electrode;

means for passing an arc forming current between the first and second electrodes to form a plasma effluent;

means for introducing an arc gas surrounding the first electrode and directed to flow through the passageway of the second electrode; and means of forming an annular passageway around said second electrode and for carrying a flow of inert gas therethrough flowing the same direction as the plasma formed by the arc and arc gas, said inert gas being heated by the second electrode as the inert gas passes toward an exit end of the torch, said exit end of the torch having a nozzle plate having a nozzle formed thereon converging from the diameter of the annular passageway carrying the inert shroud gas, the flow of heated inert gas surrounding the plasma effluent which exits from the second electrode.

2. A plasma torch for providing a plasma effluent and used in spray coating material, said torch comprising:

a body forming a housing, said body having an interior passageway;

a cathode mounted on said housing;

a tubular anode surrounding at least a portion of the cathode and extending in an axial direction away from the cathode, said tubular anode having a central bore, and an outer peripheral surface, said anode having an a exit end through which plasma exits;

a shield surrounding the peripheral surface of said tubular anode and forming an annular passageway therearound, said shield extending beyond the anode in a direction toward an outlet from the body;

means for introducing a gas into said annular passageway adjacent the end of the anode closest to the cathode, and for forcing the gas to flow in axial direction of the anode along the outer periphery surface to effect heating of the gas, said shroud gas from said annular passageway surrounding the plasma as the plasma exits from the tubular anode and moves within the shield to the outlet; and a nozzle plate mounted in said housing, said nozzle plate having a nozzle opening aligning with the end of said anode, said nozzle opening having a converging nozzle bore for causing the shroud gas and the plasma to reduce in cross-sectional size a the shroud gas and plasma exit from the plasma torch.

* * * * *

UNITED STATES PATENT AND TRADEMARK OFFICE

CERTIFICATE OF CORRECTION

PATENT NO. : 5,220,150

DATED : June 15, 1993

INVENTOR(S) : EMIL PFENDER, STUART J. MALMBERG

It is certified that error appears in the above-identified patent and that said Letters Patent is hereby corrected as shown below:

Col. 6, line 24, delete "a", insert --as--

Signed and Sealed this

Eleventh Day of January, 1994

Bruce Lehman

*Attest:*

BRUCE LEHMAN

*Attesting Officer*

*Commissioner of Patents and Trademarks*